US012534998B2

(12) United States Patent
Lowdon et al.

(10) Patent No.: US 12,534,998 B2
(45) Date of Patent: Jan. 27, 2026

(54) REAL-TIME RANGING WHILE DRILLING

(71) Applicant: SCHLUMBERGER TECHNOLOGY CORPORATION, Sugar Land, TX (US)

(72) Inventors: Ross Lowdon, Stonehouse (GB); Mahmoud Elgizawy, Bucharest (RO)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/876,721

(22) PCT Filed: Jul. 3, 2023

(86) PCT No.: PCT/US2023/069572

§ 371 (c)(1),
(2) Date: Dec. 19, 2024

(87) PCT Pub. No.: WO2024/011087

PCT Pub. Date: Jan. 11, 2024

(65) Prior Publication Data

US 2026/0002436 A1 Jan. 1, 2026

Related U.S. Application Data

(60) Provisional application No. 63/367,754, filed on Jul. 6, 2022.

(51) Int. Cl.

| | |
|---|---|
| ***E21B 47/0228*** | (2012.01) |
| ***E21B 7/04*** | (2006.01) |
| ***E21B 47/022*** | (2012.01) |
| ***E21B 47/07*** | (2012.01) |

(52) U.S. Cl.
CPC ..... *E21B 47/022* (2013.01); *E21B 7/04* (2013.01); *E21B 47/07* (2020.05)

(58) Field of Classification Search
CPC ..... E21B 7/04; E21B 47/0228; E21B 47/022; E21B 47/07
See application file for complete search history.

(56) References Cited

U.S. PATENT DOCUMENTS

| | | | | |
|---|---|---|---|---|
| 9,970,285 | B2 * | 5/2018 | Sugiura | E21B 45/00 |
| 10,392,933 | B2 * | 8/2019 | Yao | E21B 44/00 |
| 10,520,632 | B2 * | 12/2019 | Zhang | E21B 47/0228 |
| 10,768,323 | B2 * | 9/2020 | Pei | G01V 1/28 |

(Continued)

FOREIGN PATENT DOCUMENTS

EP 3312382 A1 4/2018

*Primary Examiner* — Kenneth L Thompson
(74) *Attorney, Agent, or Firm* — Jeffrey D. Frantz

(57) ABSTRACT

A method for drilling a subterranean wellbore includes rotating a bottom hole assembly (BHA) in the subterranean wellbore to drill the wellbore, the BHA including a drill collar, a drill bit, and a triaxial accelerometer set and a triaxial magnetometer set in or coupled to the drill collar. The triaxial accelerometer set and the triaxial magnetometer set make a plurality of sets of synchronized accelerometer measurements and magnetometer measurements while drilling. These synchronized measurements are processed to compute an interference magnetic field which is in turn processed to compute at least one of a distance or a direction to a magnetic target located external to the wellbore.

17 Claims, 5 Drawing Sheets

(56) References Cited

U.S. PATENT DOCUMENTS

| | | | | |
|---|---|---|---|---|
| 10,890,062 | B2 * | 1/2021 | Rodney | E21B 44/00 |
| 11,692,432 | B2 * | 7/2023 | Phillips | E21B 44/00 175/24 |
| 2013/0151157 | A1 | 6/2013 | Brooks et al. | |
| 2015/0362617 | A1 | 12/2015 | Munoz et al. | |
| 2017/0315263 | A1 * | 11/2017 | Griffing | G01V 3/28 |
| 2019/0353023 | A1 | 11/2019 | Whitacre et al. | |
| 2021/0254448 | A1 | 8/2021 | Phillips et al. | |

* cited by examiner

REAL-TIME RANGING WHILE DRILLING

CROSS-REFERENCE TO RELATED APPLICATIONS

This application is a National Stage Application of International Application No. PCT/US2023/069572, filed on Jul. 3, 2023, which claims priority from U.S. Provisional Appl. No. 63/367,754, filed on Jul. 6, 2022, herein incorporated by reference in its entirety.

BACKGROUND

In subterranean drilling operations the need frequently arises to determine the relative location of the wellbore being drilled (the drilling well) with respect to a pre-existing offset wellbore (a target well) or other subterranean structure. This need may exist for the purpose of avoiding a collision, for the purpose of making an interception, or for the purpose of maintaining a specified separation distance between the wells (e.g., as in well twinning operations). Magnetic ranging techniques may be employed to determine the relative location of the target well (or structure), for example, by making magnetic field measurements in the drilling well. The measured magnetic field may be induced in part by ferromagnetic material or an electromagnetic source (or sources) in the target well such that the measured magnetic field vector may enable the relative location of the target well to be computed.

Existing magnetic ranging techniques are commonly similar to conventional static surveys in that they require drilling to be halted and the drill string to be held stationary in the drilling well while each magnetic survey is obtained. Such magnetic ranging operations are therefore costly and time consuming. There is a need in the art for methods for magnetic ranging measurements while drilling (i.e., without halting drilling and holding the drill string stationary).

SUMMARY

A method for drilling a subterranean wellbore includes rotating a bottomhole assembly (BHA) in the subterranean wellbore to drill the wellbore, the BHA including a drill collar, a cutting tool, and a triaxial accelerometer set and a triaxial magnetometer set deployed in the drill collar. The triaxial accelerometer set and the triaxial magnetometer set make a plurality of sets of synchronized accelerometer measurements and magnetometer measurements while drilling. These synchronized measurements are processed to compute an interference magnetic field which is in turn processed to compute at least one of a distance or a direction to a magnetic target located external to the wellbore.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

For a more complete understanding of the disclosed subject matter, and advantages thereof, reference is now made to the following descriptions taken in conjunction with the accompanying drawings, in which:

FIGS. 5-1 and 5-2 (collectively FIG. 5) are flow charts of example methods for drilling a subterranean wellbore.

DETAILED DESCRIPTION

A method for drilling a subterranean wellbore includes rotating a bottomhole assembly (BHA) in the subterranean wellbore to drill the wellbore, the BHA including a drill collar, a drill bit or other cutting tool, and a triaxial accelerometer set and a triaxial magnetometer set deployed in the drill collar. The triaxial accelerometer set and the triaxial magnetometer set make a plurality of sets of synchronized accelerometer measurements and magnetometer measurements while drilling. These synchronized measurements are processed to compute an interference magnetic field which is in turn processed to compute at least one of a distance or a direction to a magnetic target located external to the wellbore. In certain advantageous embodiments, the triaxial magnetometer may include at least one eccentered transverse magnetic field sensor that is radially offset from a centerline of the drill collar. In such embodiments the interference magnetic field may include a difference between first and second magnetic field measurements made by the eccentered sensor at diametrically opposed toolface angles.

The disclosed embodiments may provide various technical advantages and improvements over the prior art. For example, in some embodiments, the disclosed embodiments provide an improved method and system for drilling a subterranean wellbore in which it is desirable to make magnetic ranging measurements to a target structure in substantially real-time while drilling (e.g., several measurements per minute or several measurements per foot or per meter of measured depth of the wellbore). The disclosed embodiments may therefore provide a much higher density of magnetic ranging measurements and/or may save considerable rig time as the ranging measurements do not require a stoppage in drilling. The ranging measurements may be advantageously utilized, for example, in wellbore intercept, wellbore avoidance, and well twinning operations.

Figure 1:
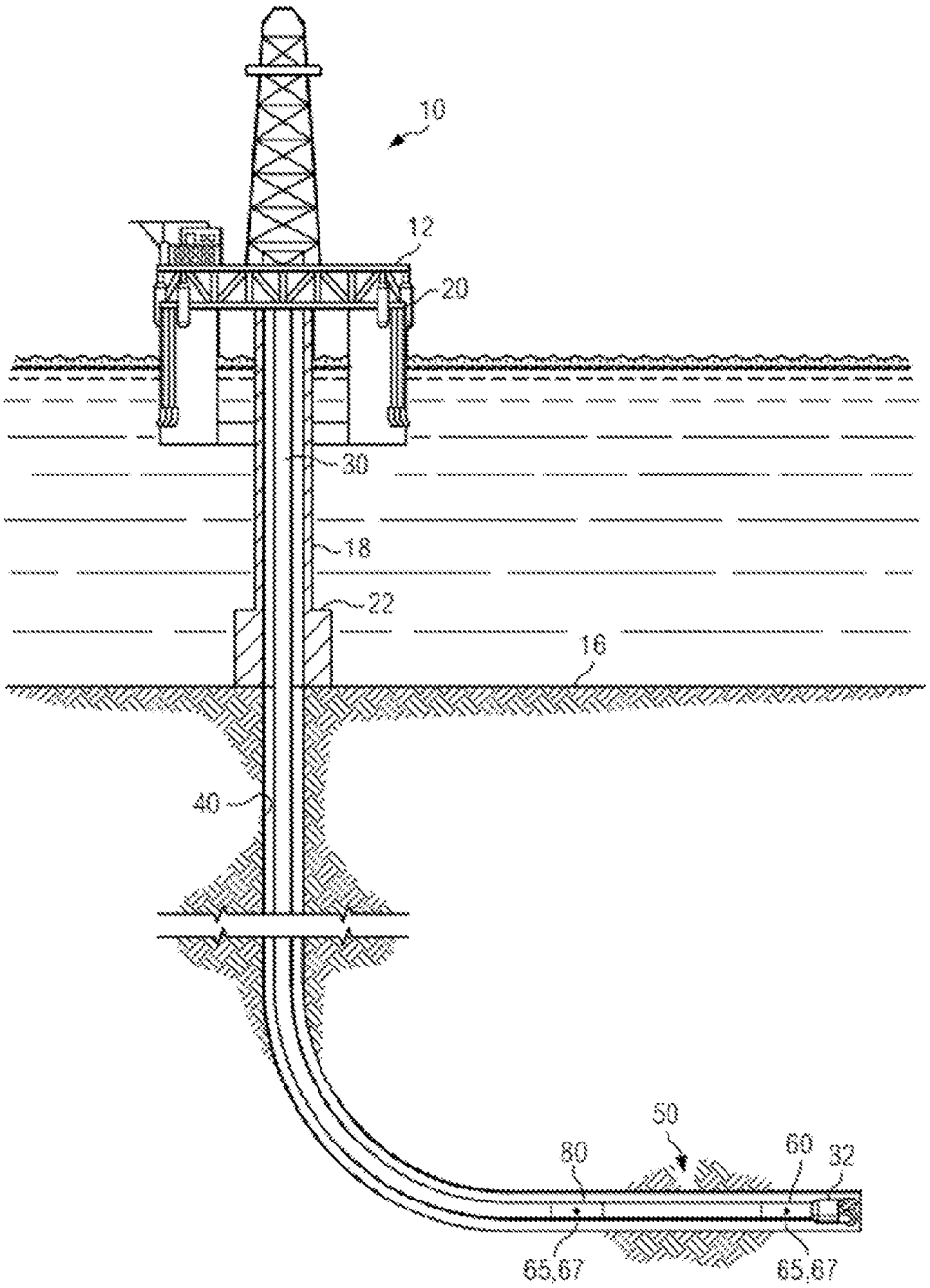
FIG. 1 depicts an example drilling environment in which disclosed embodiments may be utilized.

FIG. 1 depicts a drilling rig 10 suitable for using various method embodiments disclosed herein. A semisubmersible drilling platform 12 is positioned over an oil or gas formation disposed below the sea floor 16. A subsea conduit 18 extends from deck 20 of platform 12 to a wellhead installation 22. The platform may include a derrick and a hoisting apparatus for raising and lowering a drill string 30, which, as shown, extends into wellbore 40 and includes a cutting tool such as drill bit 32 and a rotary steerable tool 60. In some embodiments, the drill bit 32 is a fixed cutter drill bit, a roller cone drill bit, an impregnated drill bit, or a hybrid drill bit (e.g., a combination with fixed cutter blades and roller cones). In the same or other embodiments, the cutting tool can be other components in addition to, or other than, the drill bit 32, including a fixed reamer, hole opener, expandable reamer, window mill, junk mill, taper mill, dress mill, or other cutting tools.

Drill string 30 may further include a downhole drilling motor, a downhole telemetry system, and one or more MWD or LWD tools including various sensors for sensing downhole characteristics of the wellbore and the surrounding formation. The disclosed embodiments are not limited in these regards.

It will be understood by those of ordinary skill in the art that the deployment illustrated in FIG. 1 is merely an example. It will be further understood that disclosed embodiments are not limited to use with a semisubmersible platform 12 as illustrated in FIG. 1. The disclosed embodiments are equally well suited for use with any kind of subterranean drilling operation, either offshore or onshore.

Figure 2:
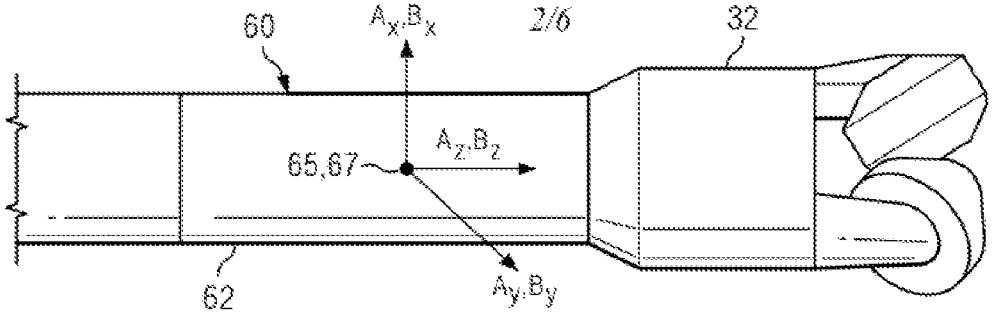
FIG. 2 depicts a lower BHA portion of the drill string shown in FIG. 1.

FIG. 2 depicts the lower BHA portion of drill string 30 including drill bit 32 and rotary steerable tool 60. In the depicted embodiment, rotary steerable tool body 62 is connected with the drill bit 32 and may be (or may not be) configured to rotate with the drill bit 32. Rotary steerable tools 60 include steering elements that may be actuated to control and/or change the direction of drilling the wellbore 40. In embodiments employing a rotary steerable tool, substantially any suitable rotary steerable tool configuration may be used. Various rotary steerable tool configurations are known in the art. For example, the AUTOTRAK® rotary steerable system (available from Baker Hughes), and the GEOPILOT rotary steerable system (available from Sperry Drilling Services) include a substantially non-rotating (or slowly rotating) outer housing employing blades that engage the wellbore wall. Engagement of the blades with the wellbore wall is intended to eccenter the tool body, thereby pointing or pushing the drill bit or other cutting tool in a desired direction while drilling. A rotating shaft deployed in the outer housing transfers rotary power and axial weight-on-bit to the cutting tool during drilling. Accelerometer and magnetometer sets may be deployed in the outer housing and therefore are non-rotating or rotate slowly with respect to the wellbore wall.

The POWERDRIVE rotary steerable systems (available from SLB of Houston, Texas) fully rotate with the drill string (i.e., the outer housing rotates with the drill string). The POWERDRIVE XCEED systems make use of an internal steering mechanism that will not require contact with the wellbore wall and enables the tool body to fully rotate with the drill string. The POWERDRIVE X5, X6, and ORBIT rotary steerable systems make use of mud actuated blades (or pads) that contact the wellbore wall. The extension of the blades (or pads) is rapidly and continually adjusted as the system rotates in the wellbore. The POWERDRIVE ARCHER systems make use of a lower steering section joined at a swivel with an upper section. The swivel is actively tilted via pistons so as to change the angle of the lower section with respect to the upper section and maintain a desired drilling direction as the bottomhole assembly rotates in the wellbore. Accelerometer and magnetometer sets may rotate with the drill string or may alternatively be deployed in an internal roll-stabilized housing such that they remain substantially stationary (in a bias phase) or rotate slowly with respect to the wellbore (in a neutral phase). To drill a desired curvature, the bias phase and neutral phase are alternated during drilling at a predetermined ratio (referred to as the steering ratio).

While FIG. 2 depicts a rotary steerable tool 60, it will be understood the disclosed embodiments are not limited to the use of a rotary steerable tool. Moreover, while the accelerometer and magnetometer sensor sets 65 and 67 may be deployed and processed in a rotary steerable tool (as depicted in FIG. 2), they may also be located elsewhere within the drill string. With reference again to FIG. 1, drill string 30 may further include a measurement while drilling tool 80 including corresponding accelerometer and magnetometer sensor sets 65 and 67. As depicted, the MWD tool 80 is commonly deployed further uphole in the drill string (i.e., above the rotary steerable tool 60). As is known to those of ordinary skill in the art, such MWD tools 80 may rotate with the drill string and may further include a mud pulse telemetry transmitter or other telemetry system, an alternator for generating electrical power, and an electronic controller. It will thus be appreciated that the disclosed embodiments are not limited to any specific deployment location of the accelerometer and magnetometer sensor sets 65 and 67 in the drill string.

With continued reference to FIGS. 1 and 2, the depicted rotary steerable tool 60 and/or MWD tool include(s) tri-axial accelerometer 65 and tri-axial magnetometer 67 navigation sensor sets, which may include any suitable commercially available devices. Suitable accelerometers for use in sensor set 65 may be chosen from among substantially any suitable commercially available devices known in the art. Suitable accelerometers may alternatively include micro-electro-mechanical systems (MEMS) solid-state accelerometers, which tend to be shock resistant, high-temperature rated, and inexpensive. Suitable magnetic field sensors for use in sensor set 67 may include conventional ring core flux gate magnetometers or conventional magnetoresistive sensors.

FIG. 2 further includes a diagrammatic representation of the tri-axial accelerometer and magnetometer sensor sets 65 and 67. By tri-axial it is meant that each sensor set includes three mutually perpendicular sensors, the accelerometers being designated as $A_x$, $A_y$, and $A_z$ and the magnetometers being designated as $B_x$, $B_y$, and $B_z$. By convention, a right handed system is designated in which the z-axis accelerometer and magnetometer ($A_z$ and $B_2$) are oriented substantially parallel with the tool axis (and therefore the wellbore axis) as indicated (although disclosed embodiments are not limited by such conventions). Each of the accelerometer and magnetometer sets may therefore be considered as determining a plane (the x and y-axes) and a pole (the z-axis along the axis of the BHA). It will be appreciated that the vector representation in FIG. 2 is diagrammatic and schematic and not necessarily intended to disclose or imply that the accelerometers and magnetometers are deployed at precisely the same location in the tool body 62.

By convention, the gravitational field is taken to be positive pointing downward (i.e., toward the center of the earth) while the magnetic field is taken to be positive pointing towards magnetic north. Moreover, also by convention, the y-axis is taken to be the toolface reference axis (i.e., gravity toolface T equals zero when the y-axis is uppermost and magnetic toolface M equals zero when the y-axis is pointing towards the projection of magnetic north in the xy plane). The magnetic toolface M is projected in the xy plane and may be represented mathematically as:

$$\tan M = B_x / B_y.$$

Likewise, the gravity toolface T may be represented mathematically as:

$$\tan T=(-A_x)/(-A_y).$$

The negative signs in the gravity toolface expression arise owing to the convention that the gravity vector is positive in the downward direction while the toolface angle T is positive on the high side of the wellbore (the side facing upward).

The disclosed method embodiments are not limited to the above described conventions for defining wellbore coordinates. These conventions can affect the form of certain of the mathematical equations that follow in this disclosure. Those of ordinary skill in the art will be readily able to utilize other conventions and derive equivalent mathematical equations.

The accelerometer and magnetometer sets 65, 67 may be configured for making downhole navigational (surveying) measurements during a drilling operation. Such measurements are well known and commonly used to determine, for example, wellbore inclination, wellbore azimuth, gravity toolface, magnetic toolface, and dipping angle (dip). Moreover, the magnetometers are further configured for measuring one or more external magnetic fields, for example, emanating from an external magnetic target. The accelerometers and magnetometers may be electrically coupled to a digital signal processor (or other digital controller) through corresponding signal analog signal conditioning circuits as described in more detail below. The signal conditioning circuits may include low-pass filter elements that are intended to band-limit sensor noise and therefore tend to improve sensor resolution and surveying accuracy.

While the disclosed embodiments are not limited in this regard, it has been found that in certain example embodiments sensitivity to external interference magnetic fields may be improved via the use of eccentered (radially offset) transverse magnetic field sensors. For example, in embodiments that make use of a triaxial magnetic field sensor (e.g., sensor 67 in FIG. 2) it may be advantageous to eccenter the $B_x$ and/or $B_y$ magnetic field sensors (the transverse magnetic field sensors). By eccenter it is meant that the $B_x$ and/or $B_y$ magnetic field sensors are radially offset from the rotational center of the tool body (e.g., tool body 62 in FIG. 2). In various embodiments the transverse magnetic field sensors may have equal or unequal eccentering distances. For example, in one example embodiment, the $B_x$ and $B_y$ magnetic field sensors may have equal eccentering distances (such that $e_x=e_y$). In another example embodiment, the $B_x$ and $B_y$ magnetic field sensors may have unequal eccentering distances (such that $e_x \neq e_y$).

Figure 3:
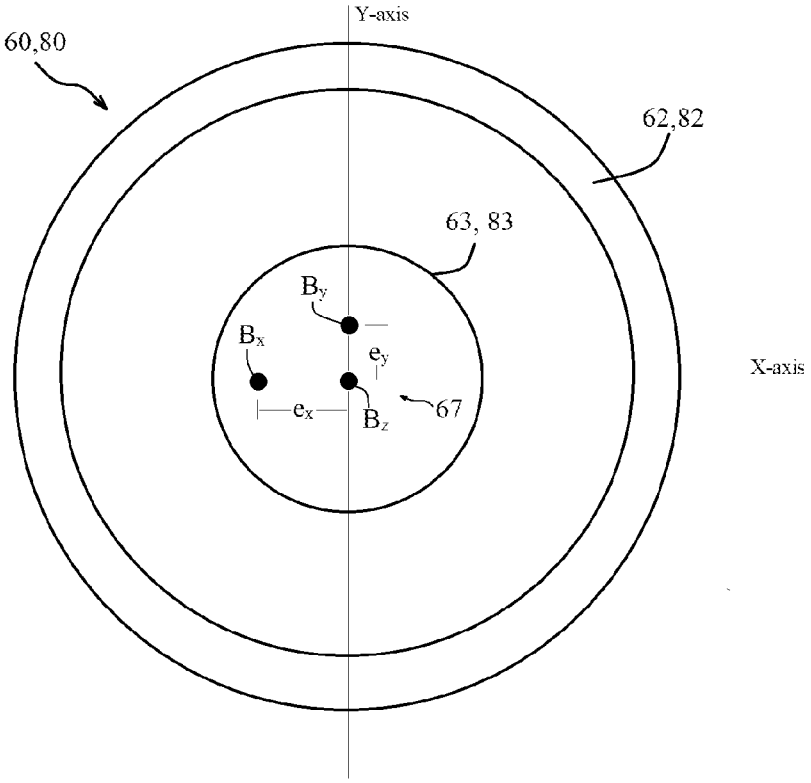
FIG. 3 is a cross-sectional view of an example measurement tool including eccentered transverse magnetic field sensors.

FIG. 3 is a cross-sectional view of an example measurement tool 60, 80 including at least one eccentered transverse magnetic field sensor. The tool 60, 80 may include, for example, a rotary steerable tool or an MWD tool as described above with respect to FIGS. 1 and 2. The tool 60, 80 includes a sensor housing 63, 83 optionally deployed centrally in a tool collar 62, 82. The sensor housing 63, 83 includes a triaxial magnetic field sensor 67 deployed therein including a centered axial magnetic field sensor $B_z$ and at least one eccentered transverse magnetic field sensor $B_x$ and/or $B_y$. In the example embodiment depicted, the transverse magnetic field sensors $B_x$ and $B_y$ are radially offset from a central location (such as the tool center along a central, longitudinal axis) by corresponding eccentering distances $e_x$ and $e_y$. As noted above, the eccentering distances $e_x$ and $e_y$ may be equal or unequal. Moreover, in certain embodiments only one of the transverse magnetic field sensors $B_x$ and $B_y$ is eccentered (such that either $e_x$ or $e_y$ equals zero).

It has been surprisingly found that the use of at least one eccentered transverse magnetic field sensor advantageously increases the interference magnetic field while ranging. The use of at least one eccentered transverse magnetic field sensor may therefore improve ranging sensitivity and/or accuracy. For example, increasing the interference magnetic field strength may advantageously enable magnetic detection and ranging to targets that are located a greater distance from the drilling well or may enable ranging to weaker magnetic targets. Moreover, increasing the interference magnetic field strength may also advantageously increase signal to noise ratio and therefore improve the accuracy of the computed distance and direction to the magnetic target.

Figure 4:
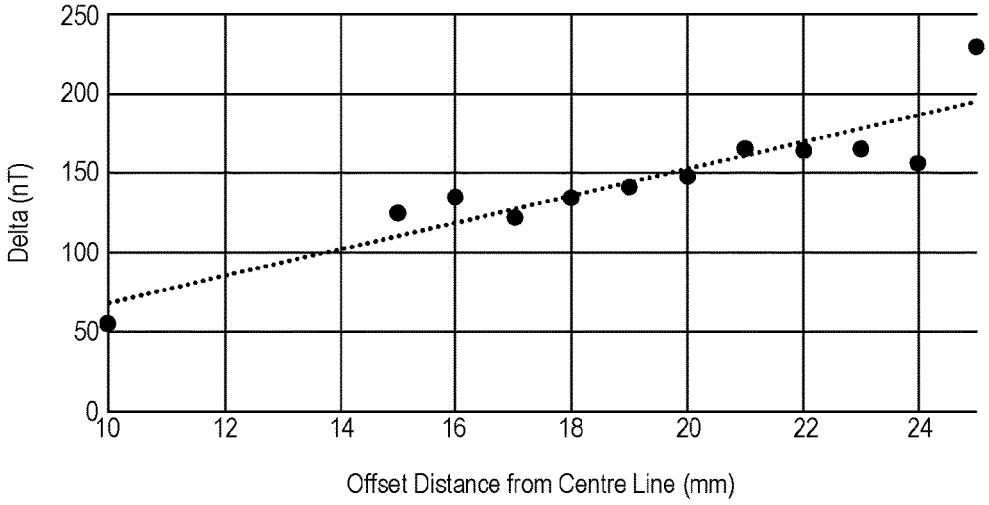
FIG. 4 is a plot of the interference magnetic field, Delta (nT), versus offset distance of an eccentered transverse magnetic field sensor.

FIG. 4 is a plot of the interference magnetic field strength (on the vertical axis) versus the transverse magnetic field sensor eccentering distance (on the horizontal axis) for one example laboratory calibration measurement in which a magnetic object was located in sensory range of the magnetic field sensors 67. In this example, the interference magnetic field is a difference between first and second magnetic field measurements made at diametrically opposed toolface angles (e.g., at toolface angles of 90 and 270 degrees in the plot). In certain embodiments, the interference magnetic field is maximized when the first and second magnetic field measurements are made at toolface angles of 90 and 270 degrees. Note also that the magnetic field strength difference (the interference magnetic field) increases substantially linearly with increasing eccentering distance. As described in more detail below the above described interference magnetic field may be advantageously used for magnetic ranging.

With continued reference to FIGS. 3 and 4, in example embodiments in which at least one transverse magnetic field sensor is eccentered, the sensor may be eccentered substantially any suitable eccentering distance. For example, in certain embodiments, the eccentering distance may be from 0 mm to 40 mm (e.g., from 10 mm to 30 mm, from 15 mm to 30 mm, or from 20 to 25 mm). The eccentering distance may also be specified with respect to the diameter of the sensor housing 63, 83. For example, the eccentering distance may be from 10% to 40% of the diameter of the sensor housing (e.g., from 20% to 40% or from 25% to 35% of the diameter of the sensor housing).

Figures 1, 5:
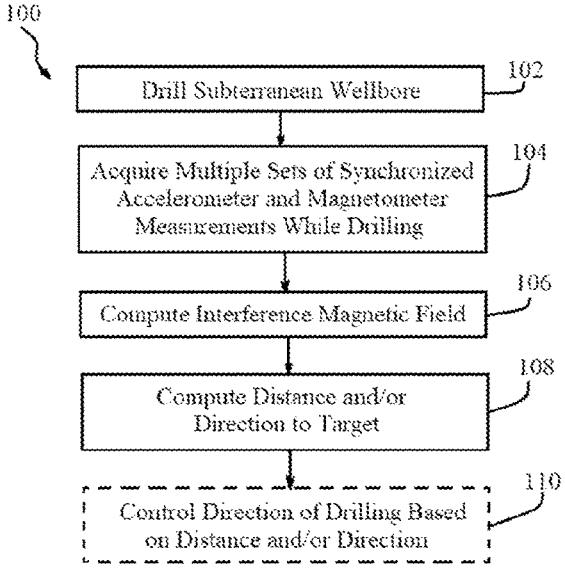
Figures 2, 5:
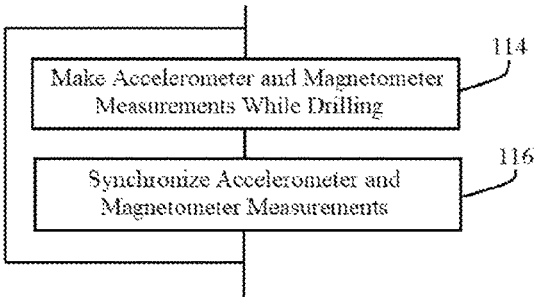

FIGS. 5-1 and 5-2 (collectively FIG. 5) are flow charts of one example method embodiment 100 for making magnetic ranging measurements while drilling a subterranean wellbore. A bottomhole assembly (e.g., as depicted on FIGS. 1 and 2) is rotated in the wellbore at 102 to drill the well. Multiple sets of synchronized accelerometer and magnetometer measurements (e.g., triaxial accelerometer and triaxial magnetometer measurements) are acquired at 104 while drilling in 102 (i.e., while rotating the bottomhole assembly in the wellbore to drill the well). For example, as shown in FIG. 5-2, acquiring the multiple sets of synchronized accelerometer and magnetometer measurements at 104 may include repeatedly making triaxial accelerometer measurements and triaxial magnetometer measurements while drilling at 114 and synchronizing those measurements at 116. In such embodiments, the plurality of sets of synchronized accelerometer and magnetometer measurements may be made sequentially and may therefore be spaced along the axis of the wellbore as drilling progresses (e.g., several sets of synchronized measurements per minute or several sets of synchronized measurements per foot (or per meter) of measured depth of the wellbore).

With continued reference to FIG. 5-1, the synchronized accelerometer measurements and magnetometer measurements are processed at 106 to compute an interference magnetic field (e.g., as described above with respect to FIG. 4). Although not depicted, the interference magnetic field may be further processed (in certain example embodiments) to compute a local magnetic field profile, e.g., including a measured magnetic vector at each measurement location along the wellbore axis. The interference magnetic field and/or the magnetic field profile may be further processed at 108 to compute at least one of a distance or a direction to the magnetic target. The computed distance and/or direction to the magnetic target may then optionally be used for wellbore position and trajectory control at 110 while drilling in 102. For example, the direction of drilling in 102 may be adjusted in response to the survey parameters (e.g., by adjusting the position of blades or other actuating components in a rotary steerable tool) to continue drilling along a predetermined path.

With reference again to FIGS. 3 and 4 and still further reference to FIG. 5, method 100 may make use of an eccentered transverse magnetic field sensor as described above. Moreover, in such embodiments, computing the interference magnetic field at 106 may further include computing differences in the transverse magnetic field when the eccentered sensor is oriented at opposing toolface angles (e.g., at toolface angles of 90 and 270 degrees).

Figure 6:
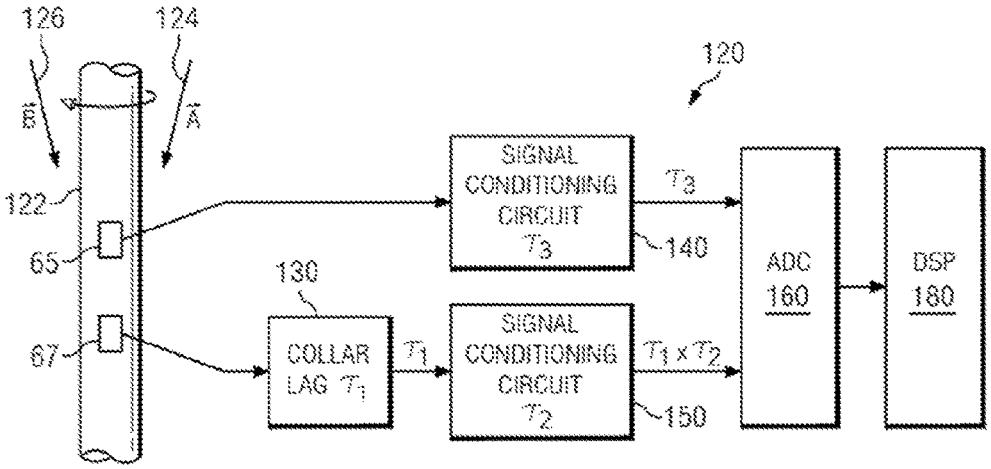
FIG. 6 is a schematic diagram of an embodiment of a system suitable for executing methods for drilling a subterranean wellbore such as the methods of FIG. 5.

FIG. 6 is an example schematic diagram of an embodiment of a system 120 suitable for acquiring the sets of synchronized accelerometer and magnetometer measurements and of executing method 100. The system 120 includes a drill collar 122 (such as drill string 30 including rotary steerable tool 60 and/or MWD tool 80) rotating in a subterranean wellbore (e.g., rotating while rotary drilling the wellbore). As described above with respect to FIG. 1, the drill collar 122 may include triaxial accelerometer and triaxial magnetometer sets 65, 67 deployed therein and configured to measure the Earth's gravitational field and the local magnetic field (including the Earth's magnetic field and any interference fields) while rotating. The gravitational and magnetic fields are depicted at 124 and 126 as acceleration vector $\vec{A}$ and field vector $\vec{B}$. Owing to the rotation of the drill collar 122, each of the accelerometers in the triaxial accelerometer set 65 measures a corresponding time varying gravitational field, $A_x(t)$, $A_y(t)$, $A_z(t)$. Likewise, each of the magnetometers in the triaxial magnetometer set 67 measures a corresponding time varying magnetic field, $B_x(t)$, $B_y(t)$, $B_z(t)$. These time varying gravitational field and magnetic field measurements are received (and filtered) by corresponding signal conditioning circuits 140 and 150. The time varying measurements are then digitized at some predetermined frequency (e.g., in a range from 100 Hz to 1000 Hz) via an analog-to-digital converter 160. The digitized measurements $A_x$, $A_y$, $A_z$ and $B_x$, $B_y$, $B_z$ are then received by a digital signal processor 180 where they are processed to compute the distance and/or direction to the target (as well as various survey parameters including, for example, wellbore inclination, wellbore azimuth, gravity toolface, magnetic toolface, and dip) in real-time while drilling. By real-time it is meant that the magnetic ranging measurements are computed while rotating the drill string to drill the wellbore (as opposed to conventional static measurements which are made while drilling has stopped). The real-time measurements may be computed at substantially any frequency, for example, in a range from 0.1 Hz to 100 Hz depending on how much averaging is employed. Such a measurement frequency corresponds to a measured depth interval ranging from a fraction of an inch to a few inches.

It will be appreciated that rotation of the drill collar 122 in the local magnetic field (or in the presence of other magnetic interference) may create an additional magnetic field in the collar bore. This additional field can cause the time varying magnetic field measured by the individual magnetometers in the magnetometer set 67 to lag behind the local magnetic field. Such drill collar lag is depicted at 130 and represented by $\tau_1$. The time varying gravitational and magnetic field measurements are received by corresponding accelerometer and magnetometer electrical signal conditioning circuits 140 and 150 prior to digitizing the signals via ADC 160. As depicted, the accelerometer circuit 140 induces a corresponding time lag and attenuation $\tau_3$ in the accelerometer measurements while the magnetometer circuit 150 induces a corresponding time lag and attenuation $\tau_2$ in the magnetometer measurements. In general, the product (or convolution) of lags $\tau_1$ and $\tau_2$ is not equal to lag $\tau_3$ such that the time varying gravitational and magnetic field measurements are generally out of phase (i.e., not synchronized). This can induce errors in computed survey parameters and magnetic ranging measurements that make use of both accelerometer and magnetometer measurements.

Figure 7:
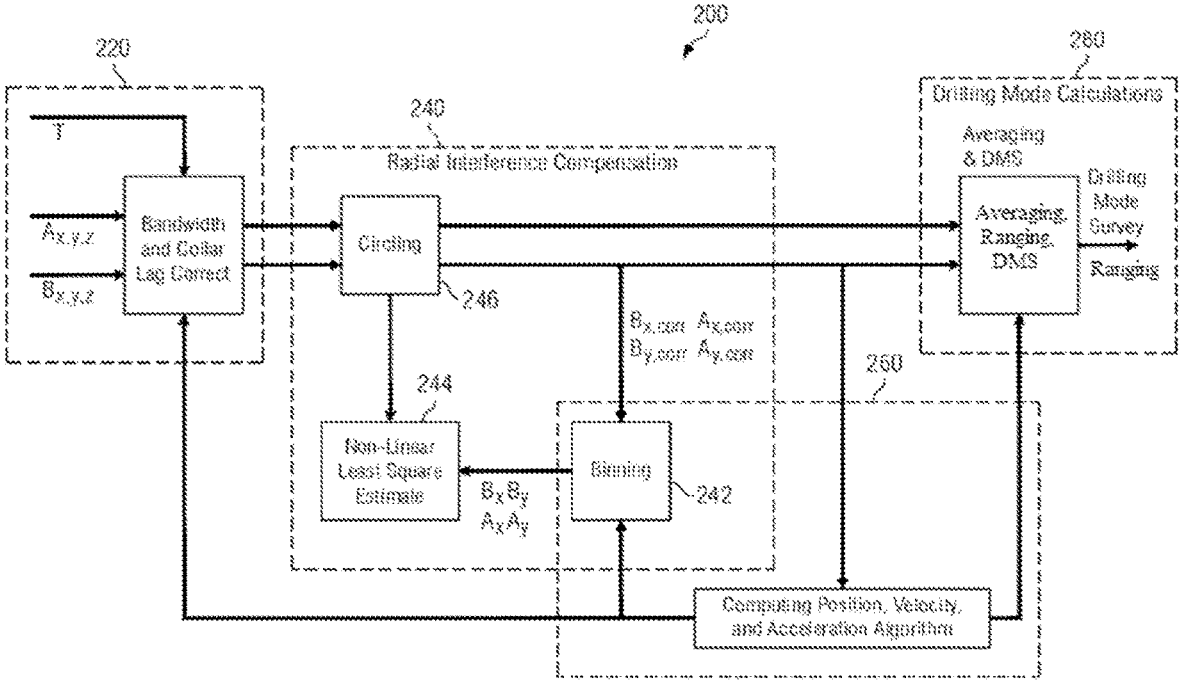
FIG. 7 is a block diagram of an example method embodiment for making magnetic ranging measurements to a target.

FIG. 7 is a block diagram of an example method 200 for magnetic ranging in real-time while drilling a subterranean wellbore. The method may be executed, for example, using a digital signal processor located in the bottomhole assembly (e.g., DSP 180 shown in FIG. 6). In the example embodiment depicted, the method 200 includes four blocks: (i) a bandwidth compensation block 220, (ii) a radial interference compensation block 240, (iii) a dynamics block 260 in which the position, velocity, and acceleration of the drill collar are computed, and (iv) a drilling mode survey block 280 in which the magnetic ranging parameters are computed (e.g., including a distance and/or direction to the magnetic target). In the example embodiment depicted in FIG. 7, the digitized accelerometer and magnetometer measurements are first processed by bandwidth compensation block 220 and then by radial interference compensation block 240 (with block 240 receiving the output from block 220 as input). It will be appreciated that such depiction is for convenience only as the processing in block 240 may alternatively precede the processing in block 220 (such that the output from block 240 is received as input in block 220). The disclosed embodiments are not limited in this regard.

With continued reference to FIG. 7, digitized accelerometer and magnetometer measurements $A_x$, $A_y$, $A_z$ and $B_x$, $B_y$, $B_z$ along with corresponding temperature measurements T are processed in the bandwidth correction block 220 to compensate (correct) attenuation and delay of the front end analog measurements (the time varying gravitational field and magnetic field measurements described above with respect to FIG. 6) introduced by signal conditioning circuits 140 and 150. Such compensation may be understood to synchronize the accelerometer and magnetometer measurements. The bandwidth correction block 220 may optionally be configured to correct for temperature variation in the time constants of the signal conditioning circuits 140 and 150 (which induce lags $\gamma_3$ and $\tau_2$). In various additional embodiments, the bandwidth correction block 220 may further apply a collar lag compensation to correct for the effect of lag $\tau_1$ on the magnetometer measurements.

Figure 8:
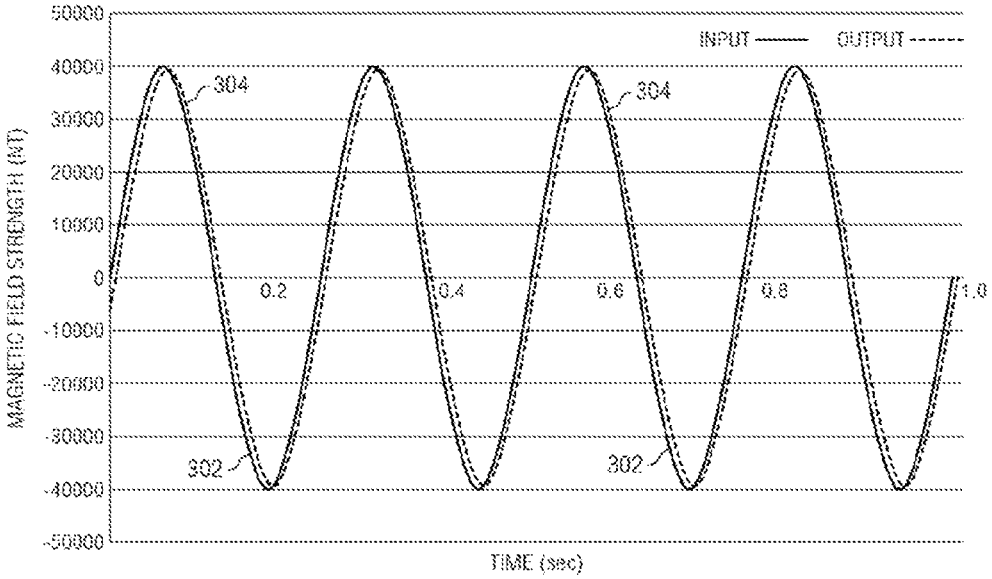
FIG. 8 is a plot of magnetic field strength versus time for a magnetometer rotating at 240 rpm.

FIG. 8 is a plot of magnetic field strength versus time for a magnetometer rotating at 240 rpm. The input magnetic field is depicted at 302 while the magnetometer output is depicted at 304. Note that in the depicted example, the magnetometer output is attenuated by 1-5%, e.g., 2% or 4%, and undergoes a phase delay of 5-15 degrees, e.g., 7 degrees, 10 degrees, or 13 degrees. While not depicted, it will be appreciated that the accelerometer output may also be attenuated and phased delayed (although generally to a different degree than that of the magnetometer output). The attenuation and phase delay may vary depending on the circuits used, the temperature, and a variety of other factors.

Figure 9:
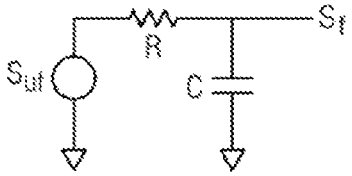
FIG. 9 depicts an example RC filter circuit.

In the frequency range of interest (e.g., from 5 to 500 rpm), the signal conditioning circuits 140 and 150 may be modelled as low pass filters having corresponding time constants. For example, each of the conditioning circuits may be modelled (e.g., approximated) as an RC filter circuit such as depicted in FIG. 9 in which $S_{uf}$ represents the unfiltered sensor signal and $S_f$ represents the filtered sensor signal. In other words, with respect to signal conditioning circuit 140, $S_{uf}$ represents the input accelerometer signal (the accelerometer signal received by the circuit 140) and $S_f$ represents the output accelerometer signal. For signal conditioning circuit 150, $S_{uf}$ represents the input magnetometer signal (the magnetometer signal received by the circuit 150) and $S_f$ represents the output magnetometer signal.

With continued reference to FIG. 9, the unfiltered sensor signal $S_{uf}$ and the filtered sensor signal $S_f$ may be related mathematically, for example, as follows:

$$S_{uf}=\tau\dot{S}_f+S_f \tag{1}$$

where $\tau$ represents the time constant of the circuit and $\dot{S}_f$ represents the first derivative of the filtered sensor signal with respect to time. The symbol $\tau$ is used herein to represent both a time constant (as in Equation 1) and the corresponding time lag and attenuation induced by the time constant (e.g., as in FIG. 6). Those of ordinary skill in the art will readily recognize that a time constant of a circuit such as signal conditioning circuits 140 and 150 may be thought of as inducing a corresponding time lag and attenuation in a signal and that the induced lag and attenuation is a function of the signal frequency.

The instantaneous unfiltered sensor signal $S(i)_{uf}$ (the signal at any instant in time) may be computed mathematically from the instantaneous filtered sensor signal $S(i)_f$, for example, as follows:

$$S(i)_{uf}=S(i)_f+S_\perp \cos\psi(\tau^2\dot{\psi}^2-3\tau^3\dot{\psi}\ddot{\psi}+3\tau^3\ddot{\psi}^2-\tau^4\dot{\psi}^4)+S_\perp \sin\psi(-\tau\dot{\psi}+\tau^2\ddot{\psi}+\tau^3\dddot{\psi}^3-6\tau^4\dot{\psi}^2\ddot{\psi}) \tag{2}$$

where $S_\perp$ represents the transverse component of the measured gravitational field or the magnetic field (e.g., such that $$A_\perp=\sqrt{A_x^2+A_y^2} \text{ and } B_\perp=\sqrt{B_x^2+B_y^2}),$$

$\psi$ represents the rotational position of the drill collar, $\dot{\psi}$ represents the rotational velocity of the rotating drill collar, and $\ddot{\psi}$ represents the rotational acceleration of the rotating drill collar. For example, $\psi$ may be related to the magnetic or gravity toolface, while $\dot{\psi}$ and $\ddot{\psi}$ may be related to the first and second derivatives of the toolface. Note that $\psi$, $\dot{\psi}$, and $\ddot{\psi}$ may be computed in and received from dynamics block 260 as described in more detail below.

With reference again to FIG. 7, bandwidth correction block 220 may compensate for the attenuation and phase delay in the accelerometer and magnetometer measurements (e.g., synchronize the measurements) via processing the digitized measurements according to Equation 2. For example, compensated x-, y-, and/or z-axis accelerometer measurements may be computed from the corresponding uncompensated measurements as follows:

$$A_c=A_{uc}+A_\perp\cos\psi\left(\tau_3^2\dot{\psi}^2-3\tau_3^3\dot{\psi}\ddot{\psi}+3\tau_3^3\ddot{\psi}^2-\tau_3^4\dot{\psi}^4\right)+A_\perp\sin\psi\left(-\tau_3\dot{\psi}+\tau_3^2\ddot{\psi}+\tau_3^3\dddot{\psi}^3-6\tau_3^4\dot{\psi}^2\ddot{\psi}\right) \tag{3}$$

where $A_c$ represent the compensated accelerometer measurement, $A_{uc}$ represent the uncompensated accelerometer measurement (e.g., $A_x$, $A_y$, and/or $A_z$ as measured) and $A_\perp$ represents the transverse component of the gravity field. In Equation 3, $\tau_3$ represents the time constant of the accelerometer conditioning circuit 140. Moreover, $\psi$, $\dot{\psi}$, $\ddot{\psi}$ and represent the rotational position, the rotational velocity, and the rotational acceleration of the drill collar (or the accelerometers in the tool collar) and may be determined, for example, as described below with respect to block 260. In some embodiments, each of the triaxial accelerometer measurements ($A_x$, $A_y$, and $A_z$) may be compensated according to Equation 3. In some embodiments only the cross-axial (transverse) measurements ($A_x$ and $A_y$) are compensated.

Likewise, compensated magnetometer measurements may be computed from the uncompensated measurements as follows:

$$B_c=B_{uc}+B_\perp cos\psi\left(\tau_2^2\dot{\psi}^2-3\tau_2^3\dot{\psi}\ddot{\psi}+3\tau_2^3\ddot{\psi}^2-\tau_2^4\dot{\psi}^4\right)+B_\perp\sin\psi\left(-\tau_2\dot{\psi}+\tau_2^2\ddot{\psi}+\tau_2^3\dddot{\psi}^3-6\tau_2^4\dot{\psi}^2\ddot{\psi}\right) \tag{4}$$

where $B_c$ represent the compensated magnetometer measurements, $B_{uc}$ represent the uncompensated magnetometer measurements, and $B_\perp$ represents the transverse component of the magnetic field. In Equation 4, $\tau_2$ represents the time constant of the magnetometer conditioning circuit 150. Moreover, $\psi$, $\dot{\psi}$, $\ddot{\psi}$ and represent rotational position, the rotational velocity, and the rotational acceleration of the drill collar (or the magnetometers in the tool collar) and may be determined, for example, as described in more detail below. In some embodiments, each of the triaxial magnetometer measurements ($B_x$, $B_y$, and $B_z$) may be compensated according to Equation 3. In some embodiments, only the cross-axial (transverse) measurements ($B_x$ and $B_y$) are compensated.

With continued reference to FIG. 7, bandwidth correction block 220 may further correct for the temperature variation in time constants $\tau_3$ and $\tau_2$ of the signal conditioning circuits 140 and 150. For example, in Equations 3 and 4, $\tau_3$ and $\tau_2$ may be expressed as corresponding functions of the measured downhole temperature T such that $\tau_3=f_3(T)$ and $\tau_2=f_2(T)$. The time constants $\tau_3$ and $\tau_2$ for each of the signal conditioning circuits 140 and 150 may be measured at various temperatures (e.g., ranging from 25 to 175 degrees C.). These temperature dependent time constant measurements may then be fit to corresponding functions $f_3$ and $f_2$ (such as to polynomial functions) or stored in corresponding lookup tables. Block 220 may be configured to process the downhole temperature measurements T to compute corresponding values of $\tau_3$ and $\tau_2$ according to $f_3$ and $f_2$ (or to obtain the values from corresponding lookup tables). These temperature dependent values of $\tau_3$ and $\tau_2$ may then be used in Equations 3 and 4 to compute the corresponding compensated measurements.

With still further reference to FIG. 7, bandwidth correction block 220 may further apply a collar lag compensation to correct for drill collar lag. As described above, drill collar lag may result as the Earth's magnetic field (or other interference magnetic field) induces an electrical current in the wall of the rotating drill collar. This electrical current in turn induces a magnetic field in the drill collar bore (e.g., at the location of the magnetometers). The net effect tends to cause the measured magnetic field to lag behind (i.e., to be phase delayed with respect to) the Earth's true magnetic field. Drill collar lag may be modelled (or approximated) as a low pass filter (in a manner similar to that described above for the signal conditioning circuits 140 and 150) having a time constant $\tau_1$. Therefore, in certain embodiments, the magnetometer measurements may be compensated for attenuation and delay introduced by both collar lag and conditioning circuit 150.

Figure 10:
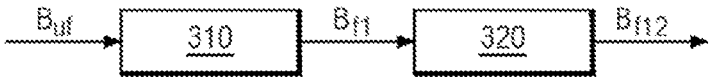
FIG. 10 is a block diagram of first and second cascading low pass filters.

FIG. 10 is a block diagram of one example embodiment in which the attenuation and delay introduced by collar lag and conditioning circuit 150 are modelled as first and second cascading low pass filters 310 and 320. In FIG. 10, the unfiltered magnetometer input $B_{uf}$ (representing Earth's true magnetic field) is attenuated and delayed by a first low pass filter 310 that models the effect of collar lag. The output from the first low pass filter 310 $B_{f1}$ is then input into a second low pass filter 320 (that models the magnetometer conditioning circuit 150) where it is further attenuated and delayed. The output from the second low pass filter 320 $B_{f12}$ (which has been attenuated and delayed by both low pass filters) is then input into the ADC.

With continued reference to FIG. 10 and reference again to FIG. 7, bandwidth correction block 220 may compensate for both collar lag and conditioning circuit 150. Compensation takes place from right to left in FIG. 10. In other words, the digitized magnetometer measurements are first compensated for the delay induced by the conditioning circuit 150 (the second low pass filter 320) and then the resultant, partially compensated quantity is further compensated for the delay induced by collar lag (the first low pass filter 310). For example, the digitized magnetometer measurements may be compensated according to Equations 5 and 6.

$$B_{c2} = B_{uc} + B_{\perp}\cos\psi\left(\tau_2^2\dot{\psi}^2 - 3\tau_2^3\dot{\psi}\ddot{\psi} + 3\tau_2^3\ddot{\psi}^2 - \tau_2^4\dot{\psi}^4\right) + B_{\perp}\sin\psi\left(-\tau_2\dot{\psi} + \tau_2^2\ddot{\psi} + \tau_2^3\dot{\psi}^3 - 6\tau_2^4\dot{\psi}^2\ddot{\psi}\right) \tag{5}$$

$$B_{c12} = B_{c2} + B_{\perp}\cos\psi\left(\tau_1^2\dot{\psi}^2 - 3\tau_1^3\dot{\psi}\ddot{\psi} + 3\tau_1^3\ddot{\psi}^2 - \tau_1^4\dot{\psi}^4\right) + B_{\perp}\sin\psi\left(-\tau_1\dot{\psi} + \tau_1^2\ddot{\psi} + \tau_1^3\dot{\psi}^3 - 6\tau_1^4\dot{\psi}^2\ddot{\psi}\right) \tag{6}$$

where $B_{uc}$ represents the uncompensated (digitized) magnetometer measurements, $B_{c2}$ represents a partial compensation in which the measurements are compensated for the delay induced by conditioning circuit 150 (and is analogous to $Bf_1$ in FIG. 10), and $B_{c12}$ represents a full compensation in which the measurements are compensated for delay induced by both collar lag and the conditioning circuit 150 (and is analogous to $B_{uf}$ in FIG. 10), $\tau_1$ represents the time constant of the first low pass filter 310 (the collar lag), and $\tau_2$ represents the time constant of the second low pass filter 320 (conditioning circuit 150). The parameters $\psi$, $\dot{\psi}$, and $\ddot{\psi}$ are as defined previously.

As described above with respect to Equations 3 and 4, correction block 220 may further correct for the temperature variation in time constants $\tau_1$ and $\tau_2$. For example, $\tau_1$ and $\tau_2$ may be expressed as functions of the measured downhole temperature T such that $\tau_1=f_1(T)$ and $\tau_2=f_2(T)$. As described above, $f_2$ may be a polynomial function obtained by empirically fitting temperature dependent time constant data (e.g., over a temperature range from 25 to 175 degrees C.). It has been found that drill collar lag tends to vary linearly with temperature (in the above recited range of temperatures), such that $f_1$ may sometimes be approximated as a linear function (a first order polynomial). Block 220 may be configured to process the downhole temperature measurements T to compute corresponding values of $\tau_1$ and $\tau_2$ according to $f_1$ and $f_2$ (or to obtain the values from corresponding lookup tables). These temperature dependent values of $\tau_1$ and $\tau_2$ may then be used in Equations 5 and 6 to compute the fully compensated magnetic field measurement $B_{c12}$ (i.e., the fully compensated magnetometer measurements).

Turning again to FIG. 7, the compensated accelerometer and magnetometer measurements may be further processed by radial interference compensation block 240 to remove distortion or interference in the transverse components of the magnetometer measurements (e.g., $B_x$, and $B_y$). In the absence of such distortion and/or interference, $B_x$ and $B_y$ trace out a circle in an x-y plot as the drill string rotates in the wellbore (e.g., while drilling). Such a circle is centered at the origin and has a radius equal to $B_{\perp}$. Local disturbances or magnetic interference can create a non-uniform magnetic field such that the locus of $B_x$ and $B_y$ is not centered at the origin and/or traces out an ellipse (rather than a circle). Such disturbances or magnetic interference may be caused, for example, by electrical current flowing through a power bus in the vicinity of the magnetometers. Moreover, a mismatch in the calibrated gains and offsets of the x- and y-axis magnetometers may also result in locus of $B_x$ and $B_y$ tracing an off-centered ellipse.

Block 240 is configured to correct $B_x$ and $B_y$ for such distortion and/or interference. The distorted locus of measurements may be expressed as an ellipse, for example, as follows:

$$\left(\frac{B_x - O_x}{At_x}\right)^2 + \left(\frac{B_y - O_y}{At_y}\right)^2 = 1 \tag{7}$$

where $O_x$ and $O_y$ represent the offsets along the x- and y-axes and $At_x$ and $At_y$ represent the attenuations along the x- and y-axes. In some embodiments, magnetometer measurements $B_x$ and $B_y$ may be collected and binned into a predefined number of azimuthal sectors at 242 while rotating (drilling). For example, the magnetometer measurements may be binned into 36 azimuthal sectors (each of which extends 10 degrees). Upon acquiring an acceptable number of measurements (e.g., when a buffer having a predetermined size is full or when a predetermined number of measurements are received in each azimuthal sector), the binned measurements, including N $B_x$ and $B_y$ measurements, are received by a fitting algorithm at 244. Assuming N pairs of $B_x$ and $B_y$ measurements, the following vector description of the measurements may be generated:

$$f(p)=\begin{pmatrix}1-\left(\frac{B_{x1}-O_x}{At_x}\right)^2+\left(\frac{B_{y1}-O_y}{At_y}\right)^2\\1-\left(\frac{B_{x2}-O_x}{At_x}\right)^2+\left(\frac{B_{y2}-O_y}{At_y}\right)^2\\\vdots\\1-\left(\frac{B_{xN}-O_x}{At_x}\right)^2+\left(\frac{B_{yN}-O_y}{At_y}\right)^2\end{pmatrix} \tag{8}$$

where $B_{x1}, B_{x2}, \ldots, B_{xN}$ and $B_{y1}, B_{y2}, \ldots, B_{yN}$ represent the N pairs of $B_x$ and $B_y$ measurements and p represents a vector of offset and attenuations values as follows:

$$p=\begin{pmatrix}O_x\\At_x\\O_y\\At_y\end{pmatrix}$$

A best fitting vector p may be computed iteratively for each pair of $B_x$ and $B_y$ measurements in Equation 8, for example, by starting with an estimated $\hat{p}$ and generating a Taylor series expansion around the estimate. The vector p approaches a best fit when the higher order terms in the Taylor series approach zero (i.e., are less than a threshold). Once solved, the best fitting vector p may be used to compute the corrected (undistorted) measurements from the distorted measurements in circling algorithm 246, for example, as follows:

$$B_{cx}=\frac{B_x-O_x}{G_x} \tag{9}$$

$$B_{cy}=\frac{B_y-O_y}{G_y} \tag{10}$$

where $B_{cx}$ and $B_{cy}$ represent the corrected (undistorted) x- and y-axis magnetometer measurements, $B_x$ and $B_y$ represent the compensated magnetometer measurements received from block 220 or alternatively the digitized magnetometer measurements from the ADC, and $G_x$ and $G_y$ represent gains that are related to the attenuations $At_x$ and $At_y$, for example, as follows:

$$At_x=(1+\Delta G)B_\perp=G_xB_\perp$$

$$At_y=(1+\Delta G)B_\perp=G_yB_\perp$$

where ΔG is given as follows:

$$\Delta G=\frac{At_y-At_x}{At_y+At_x}$$

With continued reference to FIG. 7, the rotational position, velocity, and acceleration of the drill collar may be computed at block 260 using substantially any suitable methodology. The compensated magnetometer measurements computed in block 220 may be processed to compute the rotational position, e.g., using $\psi=\arctan(B_x/B_y)$. The rotational velocity may then be computed, for example, via differentiating sequential magnetic toolface measurements, e.g., using $\dot{\psi}=[\psi(n)-\psi(n-1)]/\Delta t$, where $\psi(n)$ and $\psi(n-1)$ represent the sequential rotational position measurements and Δt represents the time between sequential measurements (e.g., 5, 10, 15, 25 milliseconds). The rotational acceleration may then be computed, for example, via differentiating sequential rotational velocity measurements, e.g., using $\ddot{\psi}=[\dot{\psi}(n)-\dot{\psi}(n-1)]/\Delta t$, where $\psi(n)$ and $\psi(n-1)$ represent the sequential magnetic toolface measurements.

The rotational position, velocity, and acceleration of the drill collar may alternatively (or additionally) be computed using a finite impulse response (FIR) filter. For example, in one such embodiment, a set of compensated magnetometer measurements may be evaluated using an FIR filter, for example, as follows:

$$x=(H^TH)^{-1}H^T\psi \tag{11}$$

where x represents the unknown vector including the rotational position, velocity, and acceleration of the drill collar, ψ represents rotational position measurements obtained from a set of K compensated magnetometer measurements, and H represents a fully determined transfer matrix, such that:

$$x=\begin{Bmatrix}\psi\\\dot{\psi}\\\ddot{\psi}\end{Bmatrix}$$

$$\psi=\begin{Bmatrix}\psi_0\\\psi_1\\\vdots\\\psi_K\end{Bmatrix}$$

$$H=\begin{Bmatrix}1&0&0\\1&-\Delta t&\Delta t\\\vdots&\vdots&\vdots\\1&-K\Delta t&K^2\Delta t^2\end{Bmatrix}$$

The right-hand side of Equation 11 represents an FIR filter structure with $(H^TH)^{-1}H^T$ being a 3×K matrix and p a moving window of K×1 observations. Thus, for each new value of ψ available, a new (or updated) value for the position, velocity, and acceleration of the drill collar may be computed. As depicted in FIG. 5, the output from block 260 (e.g., the vector x in Equation 11) may be provided to blocks 220 and 240.

With further reference to FIG. 7, various survey parameters may be computed at block 280 from the compensated accelerometer and magnetometer measurements received from blocks 220 and 240. The computed survey parameters may include, for example, wellbore inclination, wellbore azimuth, gravity toolface, magnetic toolface, and dip. The wellbore inclination Inc may be computed from the compensated accelerometer measurements, for example, as follows:

$$Inc=\arctan\left(\frac{A_{c\perp}}{A_{cz}}\right) \tag{12}$$

where $A_{c\perp}$ represents the compensated transverse component of the gravity field received from block 220 and $A_{cz}$ represents the compensated axial component of the gravity field. In some embodiments, $A_{c\perp}$ and $A_{cz}$ may be averaged over several tool rotations while drilling.

The wellbore azimuth Azi may be computed from the compensated accelerometer and magnetometer measurements, for example, as follows:

$$Azi=\arctan\left[\frac{\sin\alpha\cdot\sin\gamma}{\cos\gamma\cdot\sin(Inc)-\sin\gamma\cdot\cos\alpha\cdot\cos(Inc)}\right] \tag{13}$$

where α represents the toolface offset (the angular offset between the magnetic and gravity toolface), γ represents the angle between the longitudinal axis of the drill string (the z-axis) and the compensated magnetic field vector, and Inc represents the wellbore inclination, for example, computed according to Equation 12.

The dip angle may also be computed from the compensated accelerometer and magnetometer measurements, for example, as follows:

$$\text{Dip} = \arctan\left[\frac{\cos(Inc)\cdot\cos\gamma + \sin(Inc)\cdot\sin\gamma\cdot\cos\alpha}{\sqrt{(\sin\gamma\cdot\sin\alpha)^2 + (\cos\gamma\cdot\sin(Inc) - \sin\gamma\cdot\cos\alpha\cdot\cos(Inc))^2}}\right] \quad (14)$$

where α, γ, and Inc are as defined above. The angles α and γ may be computed from the compensated accelerometer and magnetometer measurements, for example, as follows:

$$\gamma = \arctan\left(\frac{B_{c\perp}}{B_{cz}}\right)$$

where $B_{c\perp}$ represents the compensated transverse component of the magnetic field (e.g., received from block 240), $B_{cz}$ represents the compensated axial component of the magnetic field, and $$\alpha = \arctan\left(\frac{A_{c\perp}\sin\alpha}{A_{c\perp}\cos\alpha}\right)$$

where:

$$A_{c\perp}\sin\alpha = A_{cx}\cos\psi_m + A_{cy}\sin\psi_m$$

$$A_{c\perp}\cos\alpha = A_{cy}\cos\psi_m - A_{cx}\sin\psi_m$$

where $A_{cx}$ and $A_{cy}$ represent the x-axis and y-axis compensated accelerometer measurements.

The magnetic and gravity toolface angles may also be computed, for example, as follows:

$$M = \arctan\left(\frac{B_{cx}}{B_{cy}}\right) + \beta$$

$$T = \arctan\left(\frac{A_{cx}}{A_{cy}}\right) = M + \alpha$$

where $B_{cx}$ and $B_{cy}$ represent the x- and y-axis compensated magnetometer measurements and where the angle β may be determined, for example, as follows:

$$\beta = \arctan\left(\frac{K\sin\beta}{K\cos\beta}\right)$$

$$K\sin\beta = -\sin(\text{Dip})\cdot\sin(Inc)\cdot\sin(\alpha)$$

$$K\cos\beta = \sin\gamma - \sin(\text{Dip})\cdot\sin(Inc)\cdot\cos(\alpha)$$

Drill string shock and vibration may be a potential source of error during drilling mode survey operations. Shock and vibration can be particularly problematic during vertical or near-vertical drilling operations. The above-described embodiments may optionally further include an additional vibration compensation module, for example, including a Kalman filter and/or an averaging routine to compensate for such shock and vibration.

With continued reference to FIG. 5, in embodiments that make use of a magnetic field sensor 67 including at least one eccentered transverse magnetic field sensor, block 280 may be configured to compute a difference in the magnetic field (as measured with the eccentered sensor) between first and second diametrically opposed toolface angles. As described above, such difference has been found to be sensitive to the interference magnetic field emanating from the target. Block 280 may be further configured, in such embodiments, to process the difference to compute at least one of a distance or a direction to the target in substantially real-time while drilling. For example, block 280 may be configured to process the difference to compute a magnetic field gradient, which may in turn be processed to compute the distance and direction to the target.

The computed survey parameters and/or ranging measurements may be stored in downhole memory and/or transmitted to the surface, for example, via mud pulse telemetry, electromagnetic telemetry (or other telemetry techniques). In some embodiments, the accuracy of the computed parameters may be sufficient such that the drilling operation may forego the use of conventional static surveying techniques and/or conventional static ranging techniques. In such embodiments, the wellbore survey and ranging measurements may be constructed at the surface based upon the transmitted measurements.

With reference again to FIG. 3, the survey parameters measured at 108 (and in block 280 of FIG. 5) may be used to control and/or change the direction of drilling in 110. For example, in many drilling operations the wellbore (or a portion of the wellbore) is drilled along a drill plan, such as a predetermined direction (e.g., as defined by the wellbore inclination and the wellbore azimuth) or a predetermined curvature. In certain ranging embodiments, the drilling direction may be selected to intercept a magnetic target such as another cased wellbore. In other operations the drilling direction may be selected to avoid one or more magnetic targets. In still other embodiments (such as in well twinning), the drilling direction may be selected to parallel a magnetic target. Changes in drilling direction may be implemented, for example, via actuating steering elements in a rotary steerable tool deployed above the bit. In some embodiments, the survey parameters may be sent directly to an RSS, which processes the survey parameters compared to the drill plan, (e.g., predetermined direction or predetermined curve) and changes drilling direction in order to meet the plan. In some embodiments the survey parameters may be sent to the surface using telemetry so that the survey parameters may be analysed. In view of the survey parameters, drilling parameters (e.g., weight on bit, rotation rate, mud pump rate, etc.) may be modified and/or a downlink may be sent to the RSS to change the drilling direction. In some embodiments both downhole and surface control may be used.

It will be appreciated that the methods described herein may be configured for implementation via one or more controllers deployed downhole (e.g., in a rotary steerable tool or in an MWD tool). A suitable controller may include, for example, a programmable processor, such as a digital signal processor or other microprocessor or microcontroller and processor-readable or computer-readable program code embodying logic. A suitable processor may be utilized, for example, to execute the method embodiments (or various steps in the method embodiments) described above with respect to FIGS. 5-7 and 10. A suitable controller may also optionally include other controllable components, such as sensors (e.g., a temperature sensor), data storage devices, power supplies, timers, and the like. The controller may also be disposed to be in electronic communication with the accelerometers and magnetometers, for example, as depicted in FIG. 6. A suitable controller may also optionally communicate with other instruments in the drill string, such as, for example, telemetry systems that communicate with the surface. A suitable controller may further optionally include volatile or non-volatile memory or a data storage device.

Although a surveying while drilling method and certain advantages thereof have been described in detail, it should be understood that various changes, substitutions and alterations may be made herein without departing from the spirit and scope of the disclosure. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein.

All numbers or values provided encompass numbers or values that are "about" equal to or equivalent to such number, unless the context specifically indicates a contrary interpretation. By way of example, a reference to 10% should be interpreted to be "about 10%" unless unambiguously described as exactly 10%. The term "about", as well as other terms of degree including "approximately", "substantially", and the like, represent an amount close to the stated amount that is within standard manufacturing or process tolerances, or which still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

What is claimed is:

1. A method for drilling a subterranean wellbore, the method comprising:

drilling the wellbore by rotating a bottomhole assembly (BHA) coupled to a drill string, the BHA including a drill collar, a cutting tool, a triaxial accelerometer set, and a triaxial magnetometer set coupled to or within the drill collar, the triaxial magnetometer set including at least one eccentered transverse magnetic field sensor, the eccentered transverse magnetic field sensor being radially offset from a central location on the drill collar;

while drilling the wellbore, making a plurality of sets of synchronized accelerometer measurements and synchronized magnetometer measurements with the triaxial accelerometer set and the triaxial magnetometer set;

computing an interference magnetic field by processing the synchronized accelerometer measurements and the synchronized magnetometer measurements; and computing at least one of a distance or a direction to a magnetic target located external to the wellbore by processing the interference magnetic field.

2. The method of claim 1, further comprising:

in response to computing the at least one of the distance or the direction to the magnetic target, changing a direction of drilling the subterranean wellbore.

3. The method of claim 2, wherein the drill string further comprises a rotary steerable drilling tool uphole from the cutting tool and the method further comprising:

actuating a steering element on the rotary steerable tool and thereby changing the direction of drilling.

4. The method of claim 1 wherein computing an interference magnetic field includes computing a plurality of interference magnetic fields and computing the at least one of the distance or the direction to the magnetic target located external to the wellbore further comprises:

computing a magnetic field gradient by processing the plurality of interference magnetic fields; and computing the at least one of the distance or the direction to the magnetic target by processing the magnetic field gradient.

5. The method of claim 1, wherein the at least one transverse magnetic field sensor being radially offset from the central location by an eccentering distance that is 10 mm to 40 mm or from 10% to 40% of a diameter of a sensor housing in the drill collar.

6. The method of claim 5, wherein computing the interference magnetic field includes using magnetic field measurements made by the eccentered transverse magnetic field sensor.

7. The method of claim 6, wherein the interference magnetic field is a difference between a first magnetic field measurement and a second magnetic field measurement made using the eccentered transverse magnetic field sensor, the first magnetic field measurement and the second magnetic field measurement being made at diametrically opposing toolface angles while rotating the BHA and drilling the wellbore.

8. The method of claim 1, wherein making the plurality of sets of synchronized accelerometer measurements and synchronized magnetometer measurements includes synchronizing by removing a first time lag from the synchronized magnetometer measurements and removing a second time lag from the synchronized accelerometer measurements, wherein the first time lag is not equal to the second time lag.

9. The method of claim 1, wherein making the plurality of sets of synchronized accelerometer measurements and synchronized magnetometer measurements includes synchronizing by removing a first time lag and a second time lag from the synchronized magnetometer measurements and removing a third time lag from the synchronized accelerometer measurements, wherein a convolution of the first time lag and the second time lag is not equal to the third time lag.

10. The method of claim 1, wherein making the plurality of sets of synchronized accelerometer measurements and synchronized magnetometer measurements comprises:

causing a temperature sensor to measure a downhole temperature while rotating the BHA and drilling the wellbore;

processing the downhole temperature to compute first and second time lags; and obtaining the synchronized accelerometer measurements and the synchronized magnetometer measurements by removing the first time lag from the synchronized magnetometer measurements and removing the second time lag from the synchronized accelerometer measurements.

11. The method of claim 1, wherein making the plurality of sets of synchronized accelerometer measurements and synchronized magnetometer measurements includes synchronizing accelerometer measurements and magnetometer measurements, which comprises:

with a temperature sensor, measuring a downhole temperature while rotating the BHA and drilling the wellbore;

computing a first time constant and a second time constant by processing the downhole temperature;

computing a rotational position, a rotational velocity, and a rotational acceleration of the drill string by processing the magnetometer measurements;

removing a first time lag from the magnetometer measurements by processing the first time constant and the rotational position, the rotational velocity, and the rotational acceleration of the drill string; and removing a second time lag from the accelerometer measurements by processing the second time constant and the rotational position, the rotational velocity, and the rotational acceleration of the drill string.

12. The method of claim 1, wherein making the plurality of sets of synchronized accelerometer measurements and synchronized magnetometer measurements includes synchronizing accelerometer measurements and magnetometer measurements, which comprises:

with a temperature sensor, measuring a downhole temperature while rotating the BHA and drilling the wellbore;

computing a first time constant, a second time constant, and a third time constant by processing the downhole temperature;

computing a rotational position, a rotational velocity, and a rotational acceleration of the drill string by processing the magnetometer measurements;

sequentially removing first and second time lags from the magnetometer measurements by processing the first time constant, the second time constant, and the rotational position, the rotational velocity, and the rotational acceleration of the drill string; and removing a third time lag from the accelerometer measurements by processing the third time constant and the rotational position, the rotational velocity, and the rotational acceleration of the drill string.

13. The method of claim 1, wherein making the plurality of sets of synchronized accelerometer measurements and synchronized magnetometer measurements includes synchronizing accelerometer measurements and magnetometer measurements by:

computing first and second offsets and first and second attenuations thereof by fitting transverse components of the magnetometer measurements to an ellipse; and obtaining the synchronized accelerometer measurements and the synchronized magnetometer measurements by removing the first and second offsets and the first and second attenuations from the magnetometer measurements.

14. A system for drilling a subterranean wellbore, comprising:

a bottomhole assembly (BHA) coupled to a drill string configured to rotate and thereby drill the subterranean wellbore; and a triaxial magnetometer set and a triaxial accelerometer set in the bottomhole assembly, the triaxial magnetometer set in electrical communication with a first analog circuit and the triaxial accelerometer set in electrical communication with a second analog circuit, the triaxial magnetometer set includes at least one eccentered transverse magnetic field sensor that is radially offset from a central location on a drill collar, wherein the first analog circuit and the second analog circuit are in electrical communication with an analog-to-digital converter configured to digitize signals received from the first analog circuit and the second analog circuit, wherein the analog-to-digital converter is in electronic communication with a digital signal processor configured to:

synchronize accelerometer measurements and magnetometer measurements by removing a first time lag through processing digitized magnetometer measurements and removing a second time lag through processing digitized accelerometer measurements;

compute an interference magnetic field by processing the synchronized accelerometer measurements and the synchronized magnetometer measurements; and compute at least one of a distance or a direction to a magnetic target located external to the wellbore while drilling by processing the interference magnetic field, and wherein the BHA further comprises a rotary steerable drilling tool configured to change a direction of drilling the subterranean wellbore in response to the at least one of the distance or the direction to the magnetic target computed by the digital signal processor.

15. The system of claim 14, wherein the at least one transverse magnetic field sensor being radially offset from a central axis of the drill collar by an eccentering distance that is 10 mm to 40 mm or from 10% to 40% of a diameter of a sensor housing in the drill collar.

16. The system of claim 15, the digital signal processor configured to compute the interference magnetic field using magnetic field measurements made by the eccentered transverse magnetic field sensor.

17. The system of claim 16, the interference magnetic field being a difference between a first magnetic field measurement and a second magnetic field measurement made using the eccentered transverse magnetic field sensor, the first magnetic field measurement and the second magnetic field measurement being made at diametrically opposing toolface angles.

* * * * *